US006953308B1

(12) United States Patent
Horton

(10) Patent No.: US 6,953,308 B1
(45) Date of Patent: Oct. 11, 2005

(54) OFFSHORE PLATFORM STABILIZING STRAKES

(75) Inventor: Edward E. Horton, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 0 days.

(21) Appl. No.: 10/844,264

(22) Filed: May 12, 2004

(51) Int. Cl.[7] ..... B63B 35/44
(52) U.S. Cl. ..... 405/211; 405/195.1; 405/223.1; 114/264
(58) Field of Search ..... 405/195.1, 200, 405/211, 223.1; 114/264–266, 256

(56) References Cited

U.S. PATENT DOCUMENTS 6,148,751 A 11/2000 Brown et al.
6,244,785 B1 6/2001 Richter et al.
6,349,664 B1 2/2002 Brown et al.
6,371,697 B2 * 4/2002 Huang et al. ..... 405/223.1
6,575,665 B2 * 6/2003 Richter et al. ..... 405/223.1
6,726,407 B1 * 4/2004 Steinkamp et al. ..... 405/211

* cited by examiner

*Primary Examiner*—Frederick L. Lagman
(74) *Attorney, Agent, or Firm*—Klein, O'Neill & Singh, LLP; Howard J. Klein

(57) ABSTRACT

An elongated, annular hull of a floating offshore platform includes one or more segmented, helical strakes disposed on an outer peripheral surface of the hull to reduce vortex-induced vibrations resulting from water currents. The hull may comprise a single annular hull or a plurality of parallel, adjacent hulls. Each strake includes a plurality of generally rectangular segments extending substantially radially outward from the hull. Each of the segments includes a pair of spaced-apart radial stanchions supporting a generally rectangular frame to which a corresponding panel is attached. The panels have a radial width that is about 13 percent of the effective diameter of the hull. The segments are arranged in a spaced-apart, end-to-end relationship that defines a discontinuous, but generally helical band extending around the circumference of the hull from about 35 feet (11.7 m) below the mean water line of the hull to its lowermost end.

16 Claims, 5 Drawing Sheets

OFFSHORE PLATFORM STABILIZING STRAKES

CROSS-REFERENCE TO RELATED APPLICATIONS (Not Applicable)

FEDERALLY SPONSORED RESEARCH OR DEVELOPMENT (Not Applicable)

BACKGROUND OF THE INVENTION

1. Field of the Invention

This invention relates to oil and gas drilling and production equipment in general, and in particular, to an improved form of helical strakes which are useful for stabilizing floating, deep water offshore oil and gas drilling and production platforms.

2. Description of Related Art

Offshore oil and gas drilling and production operations involve the provision of a vessel, or platform, sometimes called a "rig," on which the drilling, production and storage equipment, together with the living quarters of the personnel manning the platform, if any, are mounted. In general, offshore platforms fall into one of two classes, viz., "fixed" and "floating" platforms.

Fixed platforms comprise an equipment deck supported by legs that are seated directly or indirectly on the sea floor. While relatively stable, they are typically limited to relatively shallow waters, i.e., depths of about 500 feet (approximately 152 m), although one so-called "compliant piled tower" ("CPT") platform, called the "Baldpate" tower, is said to be operating at a depth of 1648 ft. (approximately 500 m).

Floating platforms are typically employed in water depths of about 500 ft. (approximately 152 m) and greater, and are held in position over the well site by mooring lines anchored to the sea floor, or by motorized thrusters located on the sides of the platform, or both. Although floating platforms are more complex to operate because of their movement in response to wind and water conditions, they are capable of operating in substantially greater water depths than are fixed platforms, and are also more mobile, and hence, easier to move to other well sites. There are several different types of known floating platforms, including so-called "drill ships," tension-leg platforms ("TLPs"), "semi-submersibles," and "spar" platforms.

Spar platforms comprise long, slender, buoyant hulls that give them the appearance of a column, or spar, when floating in an upright, operating position, in which an upper portion extends above the waterline and a lower portion is submerged below it. Because of their relatively slender, elongated shape, they have relatively deeper drafts, and hence, substantially better "heave" characteristics, e.g., much longer natural periods in heave, than other types of platforms, and accordingly, have been a relatively successful platform design over the years. Examples of spar-type floating platforms used for oil and gas exploration, drilling, production, storage, and gas flaring operations may be found in the patent literature in, e.g., U.S. Pat. No. 6,213,045—Gaber; U.S. Pat. No. 5,443,330—Copple; U.S. Pat. Nos. 5,197,826; 4,740,109—Horton; U.S. Pat. No. 4,702,321—Horton; U.S. Pat. No. 4,630,968—Berthet et al.; U.S. Pat. No. 4,234,270—Gjerde et al.; U.S. Pat. No. 3,510,892-Monnereau et al.; and U.S. Pat. No. 3,360,810—Busking.

Despite their relative success, spar-type platforms include some aspects that need improvement. For example, because of their elongated, slender shape, they can be relatively more complex to manage during offshore operations under some conditions than other types of platforms in terms of control over their trim and stability. In particular, because of their elongated, slender shape, spar platforms are particularly susceptible to vortex-induced vibrations ("VIV") resulting from strong currents acting on the hull of the platform. It is known that the provision of apparatus on the elongated hulls for vortex breaking, or controlled vortex-shedding, can reduce or eliminate this problem. For example, in U.S. Pat. No. 6,148,751 and U.S. Pat. No. 6,349,664, Brown et al. describe a hydrodynamic system for reducing vibration and drag on an elongated hull. In U.S. Pat. No. 6,244,785, Richter et al. describe elongated helical "strakes" disposed on a pre-cast concrete spar hull. Such prior art helical strakes typically comprise very heavy, helically formed, edge-supported plates that must be attached, e.g., by welding, to the hull while it is being fabricated in a dry dock.

While such prior art efforts at reducing or eliminating VIV of spar hulls do address the problem to some extent, they are also either relatively complex, and hence, expensive to implement, or heavy and difficult to assemble and incorporate into the hull efficiently. A need therefore exists for a simple, inexpensive, light-weight, easily assembled, yet effective apparatus for reducing or eliminating vortex-induced vibrations acting on the hulls of deep-water offshore platforms.

BRIEF SUMMARY OF THE INVENTION

In accordance with the present invention, an improved apparatus is provided for reducing or eliminating vortex-induced vibrations resulting from water currents acting on the hull of a floating platform of a type that includes an elongated, submerged, annular hull, that is used for offshore oil and gas drilling and production operations. In an exemplary embodiment, the apparatus includes one or more modular, helical strakes, each comprising a plurality of generally rectangular segments or modules that extend substantially radially outward from the hull, and that are arranged in a spaced-apart, end-to-end relationship that defines a discontinuous, generally helical band extending around a substantial portion of the lower circumference of the hull.

Each of the modules or segments of the strakes comprises a pair of spaced-apart stanchions having inner ends that are attached to the hull, and that extend substantially radially outward therefrom. A plurality of elongated circumferential members are connected to the stanchions, and a plurality of radial members are connected between the circumferential members so as to define a generally rectangular frame that is supported radially on the two stanchions. The frame has a corresponding panel attached thereto, and is additionally reinforced by a pair of angled knee braces disposed on opposite sides of the segment. Each of the knee braces has an inner end connected to the hull and an outer end connected to an outer end portion of a respective one of the stanchions. In one advantageous embodiment, the inner ends of the stanchions and the knee braces are attached to the hull adjacent to internal ring braces of the hull, and for additional reinforcement, may be respectively attached to the hull by a gusset plate.

In one possible preferred embodiment, the panel of each strake segment has a radial width that is about 13 to 14 percent of the diameter of the hull, and preferably, the strakes are installed in high loop-current areas of the hull, i.e., they have their respective upper ends disposed about 35 feet (11.7 m) below the mean water line of the hull when the hull is floating upright in water, and their respective lower ends extend down to about the lowermost end of the hull. Thus, in one particular exemplary embodiment, three helical strakes are disposed on the hull, and the panels of the strake segments each have a radial width of about 13 feet, and a circumferential length of between about 28 and 34 feet.

In a spar-type platform, the hull may comprise a single annular hull, or a plurality of annular hulls, or "cells," which are disposed adjacent and parallel to each other. Alternatively, the hull may comprise a support column of a semi-submersible offshore platform.

A better understanding of the above and many other features and advantages of the present invention may be obtained from a consideration of the detailed description below, in conjunction with the appended drawings.

DETAILED DESCRIPTION OF THE INVENTION

Figure 1:
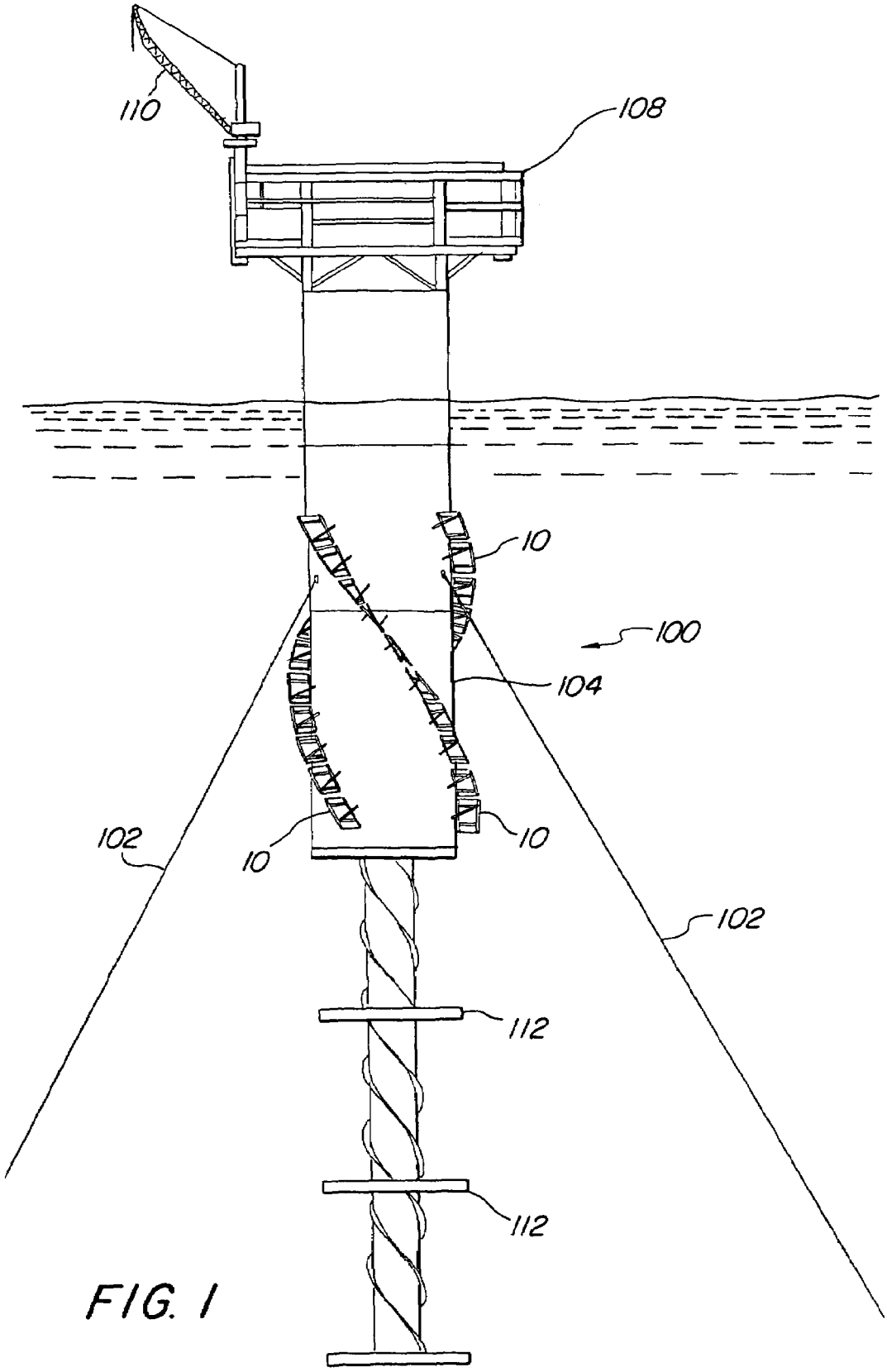
FIG. 1 is an elevation view of an offshore spar platform, shown floating upright and tethered for operations in a deep body of water, and incorporating an exemplary embodiment of segmented helical stabilizing strakes in accordance with the present invention.

An elevation view of an exemplary, spar-type offshore oil and gas drilling and production platform 100 incorporating an exemplary embodiment of segmented, helical stabilizing strakes 10 in accordance with the present invention is illustrated in FIG. 1, in which the platform is shown floating upright in a deep body of water and anchored to the seafloor (not illustrated) by a plurality of mooring lines 102. As illustrated, the exemplary spar platform comprises a single annular hull 104 having a lower portion submerged below the surface 106 of the water to a selected depth, which in one possible embodiment, may be as deep as about 500 ft. (152 m) or more, and an upper portion extending above the surface of the water to a selected height, which may be as high as 50 ft. (15 m) or greater. The particular exemplary hull illustrated may have a diameter ranging from 50 to 170 ft. (15 to 51 m), weigh between 8,000 and 30,000 tons (7,256–27,210 MT), and optionally, be capable of storing from 275,000 to 1,100,000 barrels of oil internally.

The particular spar platform 100 illustrated includes an equipment platform 108 containing drilling and/or production equipments, e.g., a derrick or crane 110, together with living quarters (not shown) for an operating crew disposed on top the hull 104. Fixed or variable ballast (not illustrated) may be disposed within the lower portion of the hull to lower the center of gravity of the platform substantially below its center of buoyancy, thereby enhancing the stability of the platform by increasing its natural period above that of the waves. In addition, steel plates 112, in the form of radially extending "heave plates," may be disposed on the exterior of a lower portion of the hull to provide damping of the heave motions of the hull.

In the particular spar platform 100 illustrated in FIG. 1, the hull 104 comprises a single annular caisson, but in an alternative embodiment, may comprise a plurality of such vertical, annular hulls, or "cells" disposed adjacent and parallel to each other. In yet another application, the hull may comprise a support column of a deep-draft, semi-submersible offshore platform of a known type. In any case, because of their relatively slender, elongated shapes, such hulls can be relatively more difficult to manage during offshore operations than other types of platforms in terms of control over their stability. In particular, because of their elongated, slender shape, such hulls are particularly subject to vortex-induced vibrations ("VIV") resulting from strong water currents acting on the hull of the platform.

Figure 7:
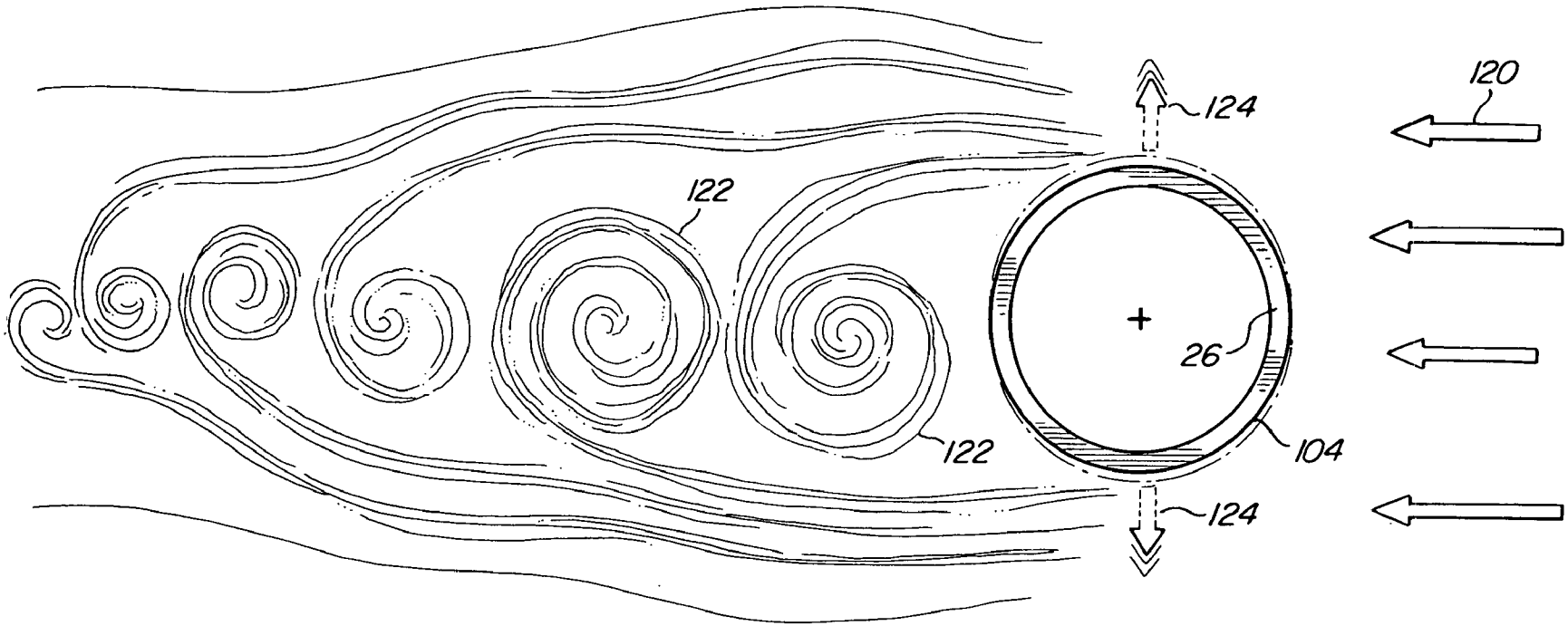
FIG. 7 PRIOR ART
FIG. 7 is a cross-sectional top plan view through a prior art spar hull, showing current-induced wake vortices acting thereon; and, FIG. 8 is a schematic cross-sectional plan view through a spar hull incorporating segmented helical strakes in accordance the present invention, showing the elimination of the current-induced wake vortices acting on the prior art hull of FIG. 7 by the strakes of the present invention.

This condition is illustrated in FIG. 7, in a cross-sectional plan view of a prior art spar hull or semi-submersible support platform 104, in which a relatively constant water current field 120 is shown flowing past the hull in the direction of the arrows. The current induces a train of vortices 122 in the wake of the hull that break away from alternating sides of the hull, thereby applying a series of alternating forces 124 that act on the hull in the directions indicated by the arrows, thereby imparting VIV. While the hull is held in position in the water by a plurality of mooring lines 102, as described above in connection with FIG. 1, the latter have a substantial amount of elasticity associated with them, and accordingly, cooperate with the floating hull and the current field to define a damped, spring-mass system that has at least one harmonic, or resonant, frequency of lateral vibration, which, if excited by a particular current flow rate, can potentially lead to the mooring lines being broken and the platform becoming catastrophically un-moored.

Figure 2:
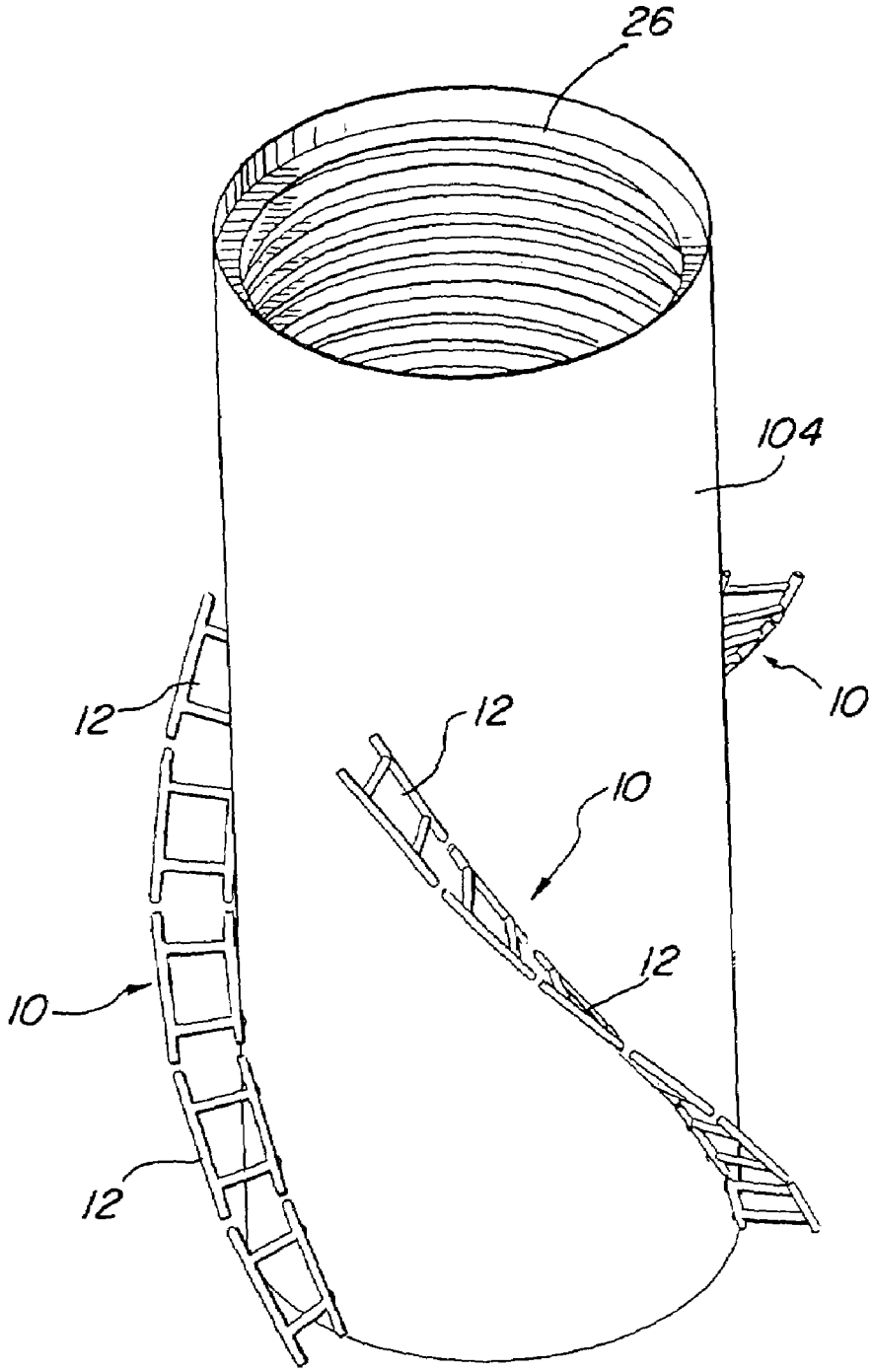
FIG. 2 is a top-and-side perspective view of a portion of the hull of the spar platform of FIG. 1, showing the rectangular frames of the novel strakes.
Figure 4:
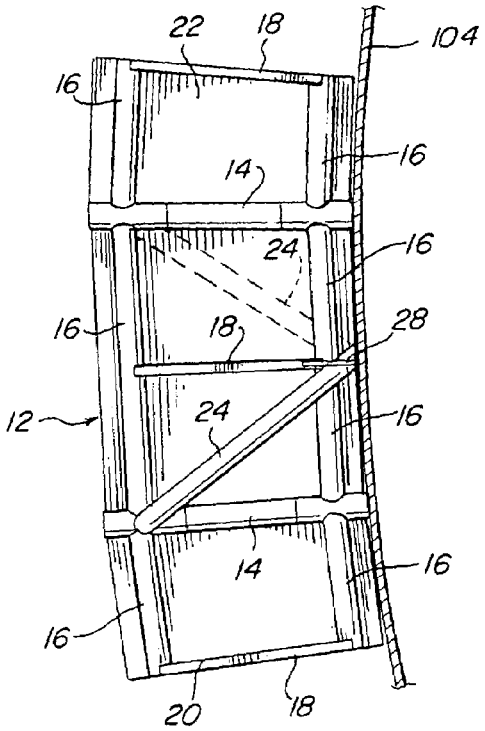
FIG. 4 is a top plan sectional view of the hull portion and strake segment of FIG. 3, as revealed by the section taken in FIG. 3 along the lines 4—4.
Figure 8:
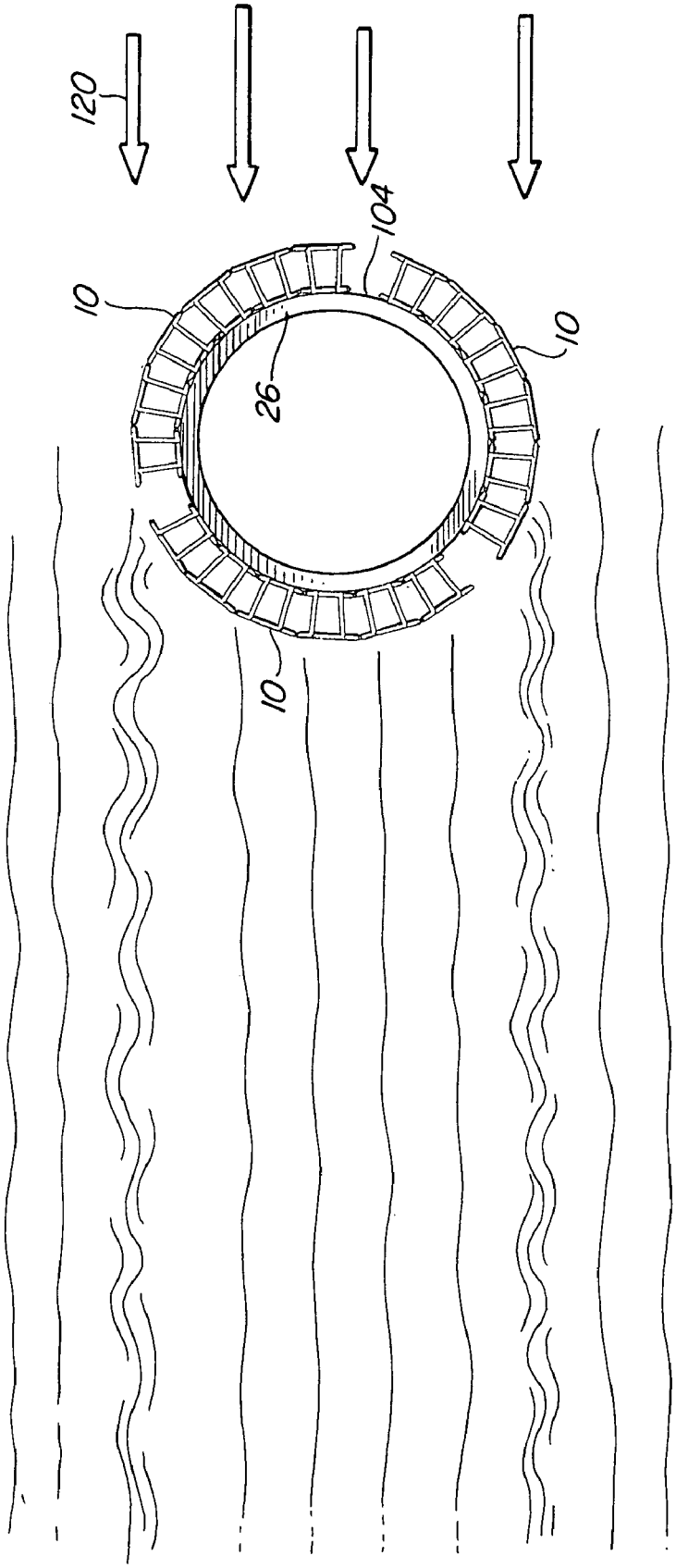

It has been discovered that the foregoing VIV of the hull 104 can be reduced or eliminated altogether by the provision of one or more "modular" strakes 10, each comprising a plurality of generally rectangular segments 12 that extend substantially radially outward from the hull, and that are arranged in a spaced-apart, end-to-end relationship that defines a discontinuous, but generally helical band extending around the circumference of a lower, high-loop-current, portion of the hull, as illustrated, for example, in the FIGS. 1 and 2. In the particular embodiment illustrated in FIGS. 1, 2 and 8, three such strakes 10 are provided, and their stabilizing effect on the hull 104 in the presence of a current field 120 is illustrated in FIG. 8. Specifically, it may be seen that the strakes 10 act to break up the wake vortices 122 of FIG. 7 before they can form on and detach from the hull, and thereby substantially reduce or eliminate altogether the potentially destructive vibrations (VIV) of the hull that could otherwise result therefrom.

As may be seen in the detail views of FIGS. 3–6, the strakes 10 may advantageously be manufactured and provided in a "modular" form, i.e., as separate modules, or "segments" 12, that can be constructed and attached to the hull 104 independently of the others, in the method described below. Each of the segments 12 of the strakes 10 comprises a pair of spaced-apart stanchions 14 having inner ends attached to the hull along a helical path around its circumference, and that extend substantially radially outward from the hull. A plurality of elongated circumferential members 16 are connected to the stanchions, and a plurality elongated radial members 18 are connected between the circumferential members 16, so as to define a generally rectangular frame 20 that is supported radially on the stanchions 14.

Figure 3:
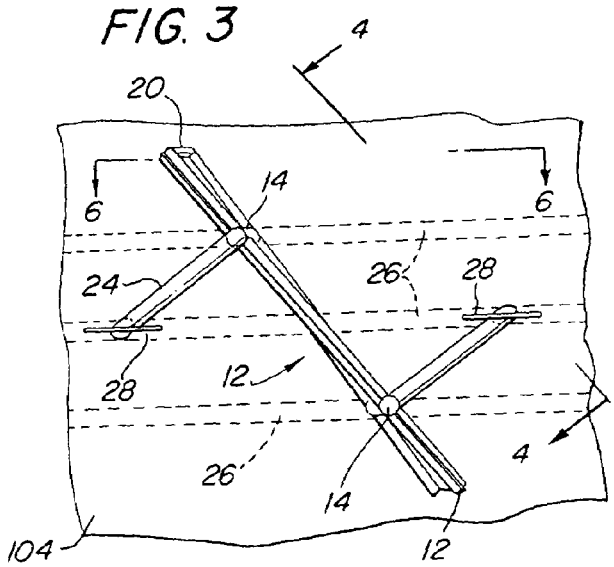
FIG. 3 is a partial elevation view of the hull portion of FIG. 1, showing a side view of a segment of one of the strakes.
Figure 5:
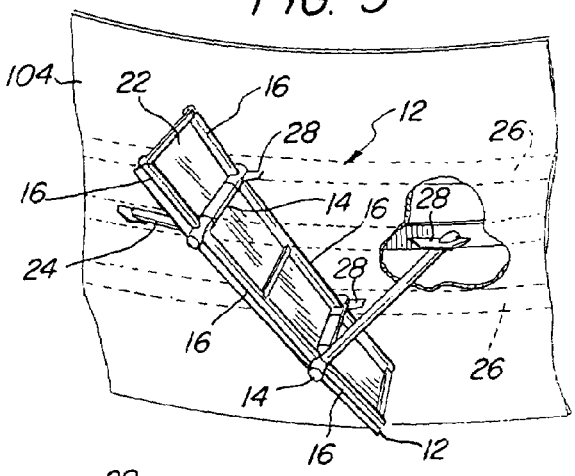
FIG. 5 is top-and-side perspective view of the hull portion and strake segment, showing a region of the hull around a knee brace of the strake broken away to reveal details of the knee brace attachment.
Figure 6:
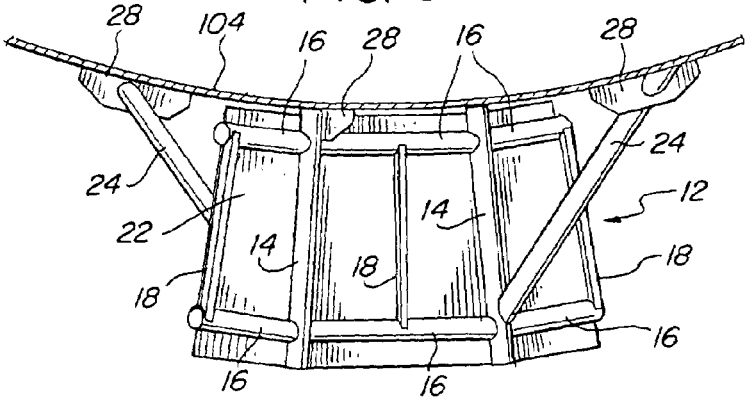
FIG. 6 is a top plan sectional view of the hull portion and strake segment of FIG. 3, as revealed by the section taken in FIG. 3 along the lines 6—6.

A panel 22, fabricated from, e.g., a flat plate or sheet stock, and having a periphery generally corresponding to that of the rectangular frame 20, is attached to the frame around the periphery thereof, such that side margins of the panel overhang the frame, as illustrated in the figures, and the frame and panel are additionally supported on the hull 104 by a pair of knee braces 24, each having an inner end connected to the hull and an outer end connected to an outer end portion of a respective one of the stanchions 14. In the particular embodiment illustrated in the figures, both the stanchions and the circumferential frame members 16 of the strake segments are tubular, but other elongated shapes may also be used advantageously for the stanchions and frame members. Also, as illustrated in the figures, the knee braces are disposed on opposite sides of the segment, and desirably, the inner ends of both the stanchions and knee braces are attached to the hull adjacent to internal "ring braces" 26 of the hull, as illustrated in FIGS. 2, 3 and 5, for added strength. For yet more reinforcement, the inner ends of the stanchions and the knee braces may be attached to the hull by gussets, or stiffener plates 28, as shown.

It should be understood that, as used herein, the term "generally rectangular," as applied to the frame 20 and the panel 22, is intended to mean that the respective circumferential members 16 of the frame and corresponding side edges of the panel are arranged to be substantially parallel at about their midpoints to a tangent drawn to the annular hull at that same point. Thus, for large hull diameters, the panel and frame will approximate a rectangle in shape, whereas, for smaller hull diameters, the frame and corresponding panel can take on an arcuate, polygonal shape having leading and trailing portions that are respectively inclined toward the hull, relative to the central portion disposed between the two stanchions 14, as illustrated in the plan view of the strake segment 12 of FIG. 4.

In an exemplary embodiment of the strakes 10, the adjacent circumferential ends of the segments 12 are spaced about 1–2 inches (2.5–5 cm) from each other, and the panels 22 (omitted for clarity in FIG. 2) of the segments have a radial width that is about 13 to 14 percent of the diameter of the hull 104, with inner side edges that are spaced apart from the hull at their midpoints by about 1–2 inches (2.5–5 cm). Accordingly, it may be seen that the side edges of the panels of the segments do not contact or attach to the hull, as in prior art helical strakes, nor are the segments of the respective strakes connected to each other to form a continuous band. Thus, in one particular exemplary embodiment of a multi-celled hull having an overall effective diameter of about 100 feet, each of the panels has a total radial width of about 13 feet (about 4 m), with side margins that overhang the sides of the corresponding rectangular frame 20 by about six inches (15 cm), and a circumferential length of between about 28 feet (8.5 m) and 34 feet (10.4 m).

It may be seen that the modular nature of the strakes 10 is advantageous in terms of their fabrication and assembly to the hull 104. For example, the hull can be fabricated in a shipyard independently of the strakes and then towed or barged to a convenient inshore assembly location. If desired, the hull can then be floated in a horizontal position in the water, and rotated about its long axis, e.g., with cranes, while the individual segments 12 of the strakes are assembled to its circumference in the helical arrangement illustrated. This is in substantial contrast to prior art strake attachment, which necessitated the relatively precise attachment of heavy, helically formed, edge-supported plates to the hull while it is disposed in a dry dock. The improved strakes of the present invention are thus not only substantially lighter and less expensive than prior art strakes, but also substantially easier to attach to the hull during outfitting.

Those of skill in this art will by now appreciate that many modifications and variations are possible in terms of the configurations, materials and methods of manufacture of the present invention without departing from its spirit and scope. For example, while the embodiments illustrated herein are shown as typical of those confected of plate and tubular steel elements, it will be understood that their design can be easily modified to incorporate other materials, e.g., reinforced concrete, and hulls with other cross-sectional configurations, e.g., polygonal. Accordingly, the scope of the present invention should not be limited by that of the particular embodiments described and illustrated herein, as these are merely exemplary in nature. Rather, the scope of the present invention should be commensurate with that of the claims appended hereafter and their functional equivalents.

What is claimed is:

1. A strake for reducing vortex-induced vibrations acting on the hull of a floating offshore platform, the strake comprising a plurality of strake segments extending substantially radially outward from the hull and arranged in a spaced-apart, end-to-end relationship defining a discontinuous, generally helical band extending around the circumference of a lower portion of the hull, wherein each of the strake segments comprises:

a pair of spaced-apart stanchions having inner ends attached to the hull and extending substantially radially outward from the hull;

a frame supported radially on the stanchions, the frame comprising a plurality of elongated circumferential and radial members connected together to define a generally rectangular periphery; and a panel attached to the frame, the panel having a periphery generally corresponding to the periphery of the frame.

2. The strake of claim 1, further comprising a pair of knee braces, each having an inner end connected to the hull and an outer end connected to an outer end portion of a respective one of the stanchions.

3. The stake of claim 2, wherein respective ones of the knee braces are disposed on opposite sides of the strake segment.

4. The strake of claim 1, wherein the hull includes a plurality of internal ring braces, and wherein the inner end of each of the stanchions is attached to the hull adjacent to one of the internal ring braces.

5. The strake of claim 1, wherein the inner ends of the stanchions are attached to the hull by a stiffener plate.

6. The strake of claim 1, wherein the panel has a radial width that is about 13 to 14 percent of the diameter of the hull.

7. The strake of claim 1, wherein the panel has an inner side edge that is spaced apart from the hull.

8. The strake of claim 1, wherein intermediate ones of the strake segments have adjacent circumferential ends that are spaced apart.

9. An improved floating offshore platform of a type that includes a submerged, elongated bull that is subject to vortex-induced vibrations resulting from the flow of current past the hull, wherein the improvement comprises a strake comprising a plurality of strake segments extending substantially radially outward from the hull and arranged in a spaced-apart, end-to-end relationship defining a discontinuous, generally helical band extending around the circumference of a lower portion of the hull, wherein each of the strake segments comprises:

a pair of spaced-apart stanchions having inner ends attached to the hull and extending substantially radially outward from the hull;

a frame supported radially on the stanchions, the frame comprising a plurality of elongated circumferential and radial members connected together to define a generally rectangular periphery; and a panel attached to the frame, the panel having a periphery generally corresponding to the periphery of the frame.

10. The offshore platform of claim 9, further comprising a pair of knee braces, each having an inner end connected to the hull and an outer end connected to an outer end portion of a respective one of the stanchions.

11. The offshore platform of claim 10, wherein respective ones of the knee braces are disposed on opposite sides of the strake segment.

12. The offshore platform of claim 9, wherein the hull includes a plurality of internal ring braces wherein the inner end of each the stanchions is attached to the hull adjacent to one of the internal ring braces.

13. The offshore platform of claim 9, wherein the inner ends of the stanchions are attached to the hull by a stiffener plate.

14. The offshore platform of claim 9, wherein the panel has a radial width that is about 13 to 14 percent of the diameter of the hull.

15. The offshore platform of claim 9, wherein the strake has an upper end disposed below the mean water line of the bull when the hull is floating upright in water.

16. The offshore platform of claim 15, wherein the strake has an upper end disposed at about a lower end of the hull.

* * * * *

UNITED STATES PATENT AND TRADEMARK OFFICE

CERTIFICATE OF CORRECTION

PATENT NO. : 6,953,308 B1
APPLICATION NO. : 10/844264
DATED : October 11, 2005
INVENTOR(S) : Edward E. Horton It is certified that error appears in the above-identified patent and that said Letters Patent is hereby corrected as shown below:

- The word "bull" in column 8, line 23 should read --hull--.

Signed and Sealed this

Twenty-eighth Day of November, 2006

JON W. DUDAS
*Director of the United States Patent and Trademark Office*